US010611443B2

(12) United States Patent
MacDonald

(10) Patent No.: US 10,611,443 B2
(45) Date of Patent: Apr. 7, 2020

(54) BODY SURFING BOARD

(71) Applicant: Brock MacDonald, Honolulu, HI (US)

(72) Inventor: Brock MacDonald, Honolulu, HI (US)

( * ) Notice: Subject to any disclaimer, the term of this patent is extended or adjusted under 35 U.S.C. 154(b) by 0 days.

(21) Appl. No.: 16/164,200

(22) Filed: Oct. 18, 2018

(65) Prior Publication Data

US 2019/0047667 A1 Feb. 14, 2019

Related U.S. Application Data

(63) Continuation-in-part of application No. 15/675,149, filed on Aug. 11, 2017, now abandoned.

(51) Int. Cl.
*B63B 35/79* (2006.01)

(52) U.S. Cl.
CPC ..... *B63B 35/7926* (2013.01); *B63B 35/7906* (2013.01); *B63B 2035/7903* (2013.01)

(58) Field of Classification Search
CPC ..... B63B 35/00; B63B 35/73; B63B 35/79; B63B 35/7906; B63B 35/7926; B63B 35/81
USPC ..... 441/65, 74
See application file for complete search history.

(56) References Cited

U.S. PATENT DOCUMENTS 4,439,165 A * 3/1984 Rothstein ..... B63B 35/7906 441/65
10,293,898 B2 * 5/2019 Villarreal ..... B63B 35/79
2008/0020660 A1 * 1/2008 Barney ..... B63B 35/7906 441/65
2010/0273372 A1 * 10/2010 Parsia ..... B63B 35/79 441/74

* cited by examiner

*Primary Examiner* — Lars A Olson
(74) *Attorney, Agent, or Firm* — Hawaii Patent Services; Nathaniel K. Fedde

(57) ABSTRACT

One embodiment of this invention provides a body sure article providing a planing device having an inclined shape behind a leading edge, forming a planking effect when in use and an overall size and shape that allows a specific position relative to a user's arms and/or elbows. A material is used having a density sufficient to be slightly buoyant relative to water, but is easily submerged under waves momentarily without substantial opposition force to a user duck diving.

14 Claims, 6 Drawing Sheets

BODY SURFING BOARD

TECHNICAL FIELD

The present invention relates to devices for recreational surfing and, more particularly, to an improved body surfing board.

BACKGROUND

Modern surfboards are made of polyurethane or polystyrene foam covered with layers of fiberglass cloth, and polyester or epoxy resin. The boards are relatively light, and buoyant and maneuverable. However, they need to be strong enough to support the weight of an individual standing on them while riding the surface of a breaking wave.

Bodyboarding is a water sport in which the surfer rides a bodyboard in lieu of a surfboard. Bodyboarding is also referred to as Boogieboarding due to the invention of the now genericized brand name "Boogie Board" for one of the first commercially available designs. A typical device for bodyboarding consists of a short, rectangular piece of hydrodynamic foam. Bodyboarders typically use swim fins for additional propulsion and control while riding a breaking wave.

From the first boogieboards to the bodyboarding devices available today, these devices have been derived from and based upon the technology and developments of surf boards. This appears due to the similarity in function, namely, aiding a user in riding the surface of a breaking wave.

However, there are some differences in the mode of transport between bodyboarding and bodysurfing that appears to be overlooked. In the breaking of water surface waves on a coastline of the type sought by surfers, the amplitude of the wave reaches a point where the crest of the wave actually overturns. Such wave breaking causes numerous fluid dynamic effects, including the aeration of the surface water in the creation of a whitewater "foam".

A surfer riding a surf board is not affected by the changes in water density in passing through the whitewater in the same way as is a bodysurfer. A bodysurfer is riding a much smaller, much lighter and generally very buoyant device in a prone position and resting the rider's torso upon the board while grasping the leading or side edges. This change in attitude and more intimate contact with the aerated whitewater can result in a lack of control when a bodysurfer passes through the wave.

Some methods and devices are known that incorporate various mechanisms for bodysurfing. For example:

U.S. Pat. No. 5,389,023, issued in the name of McIntyre, discloses a body surfing board that includes a flexible hull having a lower surface, an upper surface adapted to receive a swimmer, and a nose section defining a forward end of the hull. A tail section including a keel extends downwardly from the lower surface of the hull. A pair of fins extend downwardly from the hull along opposite lateral edges thereof. The fins are each pivotable along their respective attachment to the hull, inwardly and outwardly with respect to one another. A plurality of slits extend between the pair of fins for translating the force of a water wave into forward movement of the body surfing board. In one embodiment, a plurality of ribs fixed to the lower surface of the hull define the slits. In another embodiment, a plurality of ribs are positioned within the nose section of the hull to open and close the slits in response to movement of the fins. In still another embodiment, the slits are incorporated into a diaphragm member. A pair of pommels are fixed to the hull to support the backs of the swimmer's arms. The tail section may include a tail fin attached to the keel within one of a plurality of channels. The fins may include sleeves or external hand grips.

U.S. Pat. No. 8,821,203, issued in the name of Ellis, discloses a body surfing hydrofoil that includes a breastplate having a buoyant material extending between an inner surface and outer surface. The breastplate has a generally rigid planar shape defined by a perimeter having opposing sides diverging outwardly from a top portion to a bottom portion. A spacer is affixed to the inner surface of the breastplate and is sufficiently flexible for compressing and retracting as a result of breathing by a person biased against the spacer. A rear flotation member is integrally connected to the breastplate.

U.S. Pat. No. 8,998,665, issued in the name of Hoskins, discloses a body board system for giving a user a greater sense of maneuverability and control when using the body board. The system features a generally planar body board having a channel located in a body board top surface. The system features a first pivoting base located in a channel first end and a second pivoting base located in a channel second end. A handle assembly is pivotally located on the top surface and features a handle with a handle first end pivotally located on the first pivoting base and a handle second end pivotally located on the second pivoting base. For a first position, the handle is adapted to be pivoted from the channel and raised to an angle for use by a user and for a second position the handle is adapted to be pivoted into the channel.

U.S. Pat. No. Des 305,144, issued in the name of Shanelec, discloses an ornamental design for a bodysurfing board.

U.S. Pat. No. Des. 317,343, issued in the name of Concannon, discloses another ornamental design for a bodysurfing board. This design somewhat resembles the present innovation in a cursory manner, but with some major functional differences, including: the lack of an edge detail that incorporates a wave-gripping edge; and the inclusion of pontoons or hulls as opposed to narrow, non-floatational fins.

And, U.S. Patent Publication No. US2008/0020660, published in the name of Barney, describes a body surfing article, which is attachable to, and can be worn about, a person's upper torso, includes a chest plate and, extending from either side of the chest plate, is preferably a pair of fins. Flexible shoulder straps may be attached to an upper edge of the chest plate for securing the chest plate to the user's torso and flexible side portions may extend from sides of the chest plate for fastening with the flexible shoulder straps behind the user's back. The fins separation, or spacing between the fins, defines a planing surface, so that the user can move both forwards and laterally across the face of a wave.

The present inventor has discovered a configuration for a body board in which it is beneficial to have the board be substantially non-buoyant and be sized to position the greater mass of a rider's torso in a balanced position. The inventor has further discovered that the board can be configured to allow for easy handling and control by the rider, and still being short enough to allow the ride free use of his or her leg's for steering.

The prior art fails to meet the aforementioned needs. Prior to the present invention, there has not been provided an apparatus that includes all these functionalities while at the same time allowing the rider to pass through the aerated whitewater in a consistent and controlled manner.

SUMMARY OF THE INVENTION

It is thus an object of the present invention to provide an improved body surfing board for recreational surfing.

It is a further object of the present invention to provide such a body surfing board that includes an inclined shape of the leading edge forming a planking effect when in use.

It is yet another object of the present invention to provide such a body surfing board having an overall size and shape that allows a specific position relative to a user's arms/elbows.

It is yet a further object of the present invention to provide such a body surfing board that, while non-buoyant, provides a tether connected to a grommetted aperture to allow leashing to the user in order to minimize loss.

A body surf article of the invention comprises a deck having:

a. an upper surface on a top side of the deck;
b. a lower surface on an under side of the deck that inclines to a leading end imparting a planking effect when it travels on water; and
c. a size that accommodates the forward of a user, e.g. a length of less than 30 inches from the leading end to a trailing end of the deck, and a width of less than 18 inches from a first lateral end to second lateral end of the deck.

As taught herein, body surf article is configured to be substantially non-buoyant such that the body surf article is minimally affected by waves and other water movement. The entire body surf article, or deck thereof, has a density in the vicinity of water, e.g. about 0.65 grams/$cm^3$ to about 1.2 grams/$cm^3$. As a specific example, the density can be about 0.9 grams/$cm^3$ to about 1 gram/$cm^3$.

Optionally, the lower surface comprises a portion behind the inclination that is substantially planar, optionally wherein substantially all or a majority of the lower surface behind the inclination is substantially planar, and further, the upper surface comprises a portion that is substantially planar, optionally, wherein substantially all or a majority of the upper surface is substantially planar.

Optionally, the body surf article comprises two halves (e.g. identical halves), and each half of the deck comprises a fin and a lateral end, wherein the fin protrudes downward from the lower surface and spanning longitudinally towards the trailing edge, and wherein the fin is offset laterally from the lateral end of the respective half such that the lateral end of each of the respective halves provides a respective first edge running longitudinally on the underside of said deck, and is offset laterally from a bottom edge of the fin of the respective half, and wherein the fin is closer to said lateral end of the respective halves than an imaginary longitudinal center plane of said deck. Optionally, the fin is tapered downward from the lower surface. Optionally, the height of the fin is greater at the rear of the fin than the front of the fin. Optionally, the taper of the fin is configured such that the fin is gradually sloped to become flush with the lower surface.

Optionally, the body surf article comprises on each of said halves, a second lateral edge, wherein the second lateral edge is laterally positioned between the fin of the respective half and the first lateral edge of the respective half, and wherein the second lateral edge is positioned at a height that is lower than the first lateral edges and higher than the bottom of the fins, wherein the second lateral edge runs longitudinally on the underside of said deck.

Optionally, the body surf article comprises on each of said halve, a concave surface connecting the second lateral edge of the respective half and the first edge of the respective half.

Optionally, the lower surface comprises, on each of said halves, a first surface portion that is substantially perpendicular to the fin of the respective half and extends towards the imaginary center plane of the lower surface from the second lateral edge of the respective half. Optionally, said first surface portion connects the second lateral edge of the respective half to the top of the fin of the respective half.

Optionally, the lower surface is configured to provide, on each of said halves, a first longitudinal void channel between the bottom of the fin of the respective half and the second lateral edge of the respective half to allow the passage of water as the surf body article travels through water.

Optionally, the lower surface is configured to provide, on each of said halves, a second longitudinal void channel between the first lateral edge of the respective half and the second lateral edge of the respective half to allow the passage of water as the surf body article travels through water.

Optionally, the leading end comprises a flange having a finger grip.

Optionally, the deck and fins are molded or formed as a unitary body.

Optionally, said fins terminate at a height of approximately less than 1 inch below the lower surface.

Optionally, said leading end terminates at a height of about one inch to about three inches higher than a base of said lower surface, and optionally said inclination connects said termination to said base.

DETAILED DESCRIPTION OF THE INVENTION

Overview

As an illustrative example, a body surf article of the present invention can have one or more (or all) of the following features;

a. a deck comprising an upper surface and a lower surface;
b. an upper surface sized to support the forearm of a user;
c. a lower surface with a planar section and a front inclination configured to provide a planking effect;
d. wave-gripping features such as fins and lateral edges;
e. longitudinal channels (voids) provided between gripping features which allow the wave-gripping features to "bite" into to the wave; and
f. a density that is similar to that of water.

Taken together, the combination of features comprised by the present body surf article provides a vastly improved surfing device that provides ease of entrance to a wave, greater control and maneuverability while on the wave, and reduces the burden for swimming out from shore by minimizing undesired wave impact and aiding in duck diving.

Upper Surface

Figure 1:
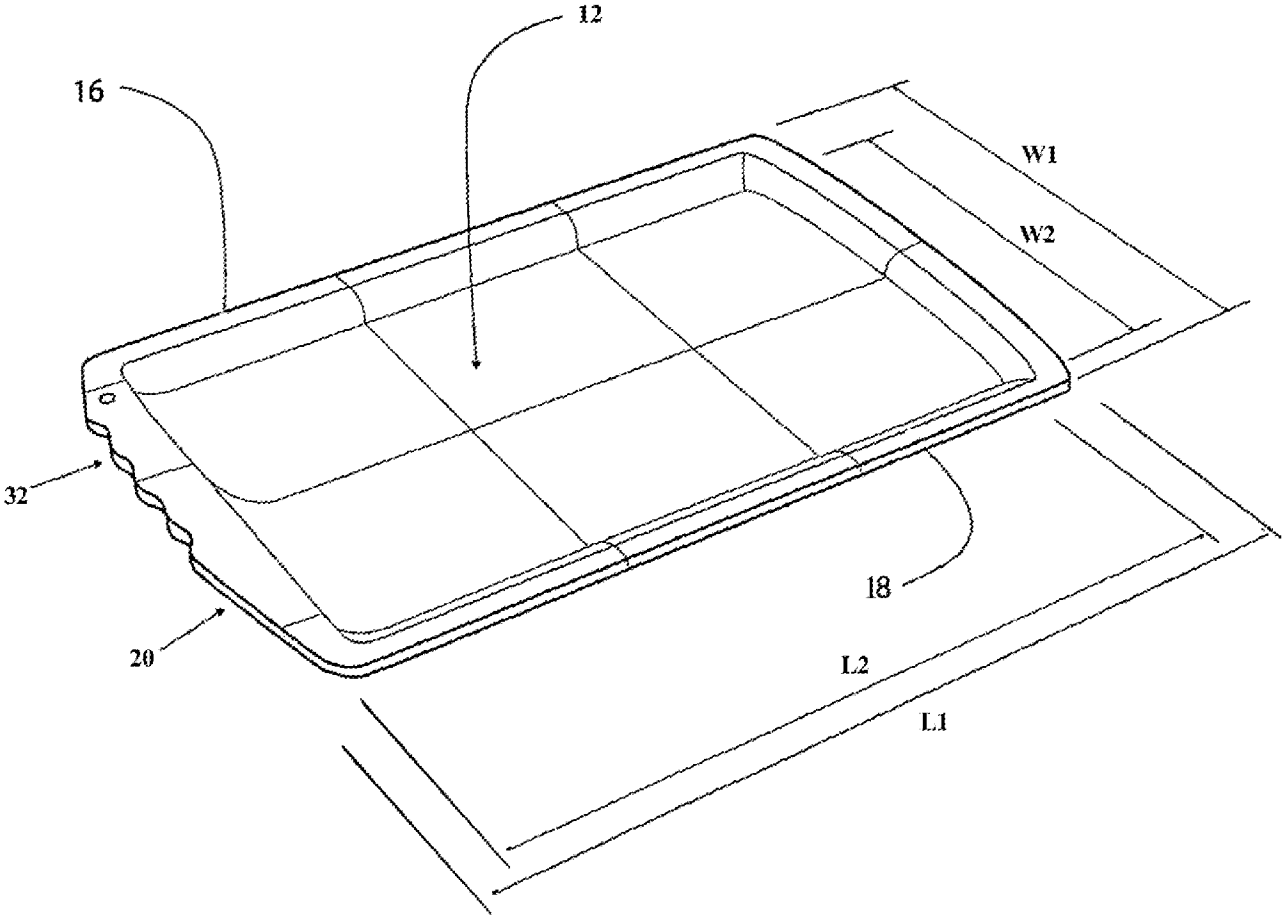
FIG. 1 depicts a front perspective view of an improved body surfing board according to the preferred embodiment of the present invention.

A body surf article of the present invention comprises an upper surface on a top side of the deck, for example, upper surface 12 depicted in FIG. 1. The upper surface can provide contact surface for supporting a user's forearm.

Optionally, the upper surface comprises a generally planar portion. Optionally, substantially all or a majority of the upper surface is substantially planar.

Optionally, the upper surface comprises sidewalls, e.g. such that the generally planar portion is inset down from edges of the upper surface. The sidewalls can optionally be inclined to provide a smooth transition to the edges.

Figure 3:
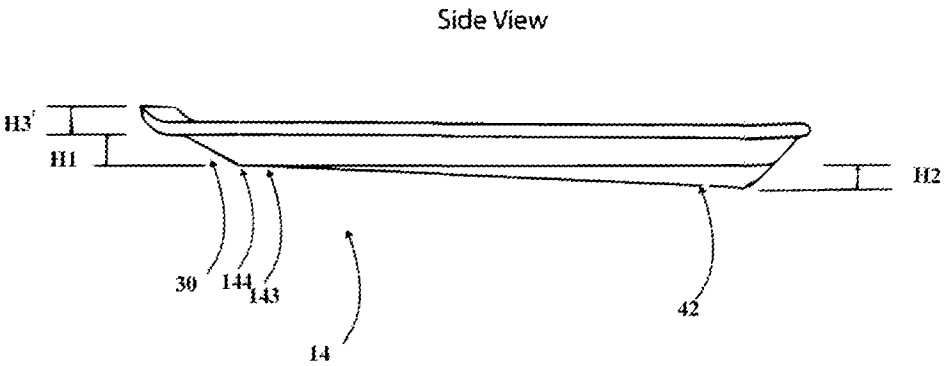
FIG. 3 is a left side elevational view thereof.
Figure 4A:
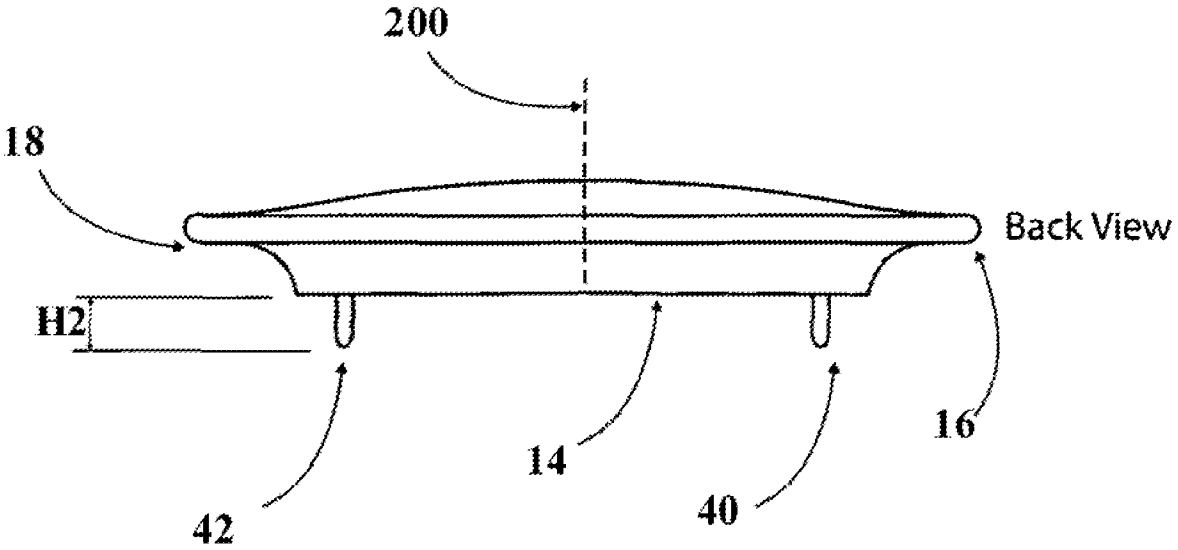
FIG. 4A is a rear elevational view thereof.
Figure 4B:
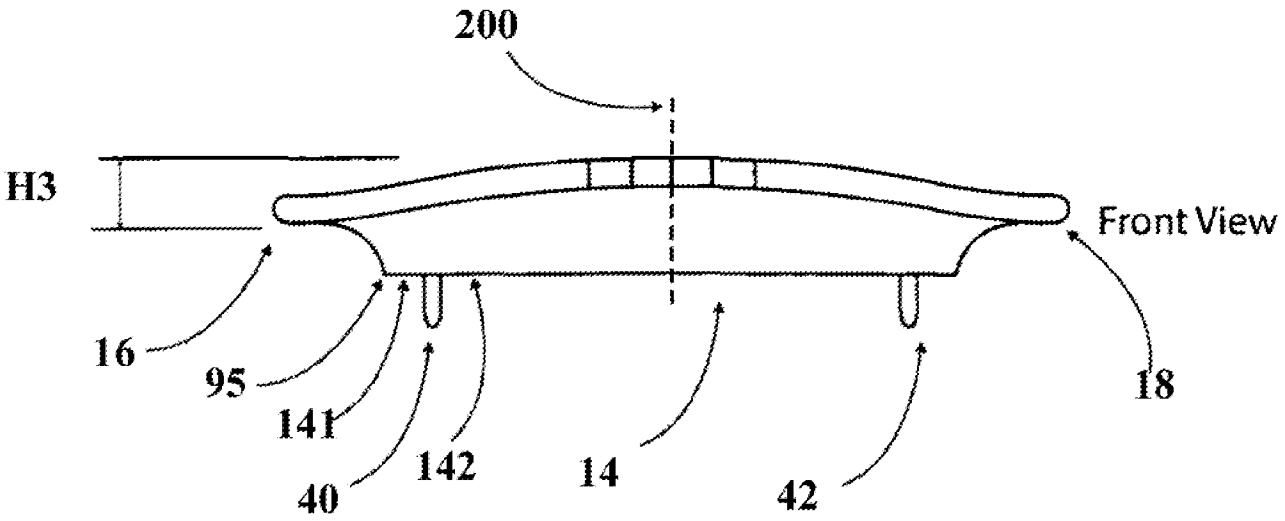
FIG. 4B is a front elevational view thereof.

Lower Surface,

A body surf article of the present invention comprises a lower surface on an under side of the deck that inclines to a leading end, for example, lower surface 14 depicted in FIGS. 3, 4A, and 4B.

Optionally, the lower surface comprises a generally planar section (e.g. the portion of lower surface 14 that is behind inclination start 144) and an inclination in front the generally planar section (e.g. inclination 30). Optionally, substantially all or a majority of the lower surface behind the inclination is generally planar, as shown in FIGS. 3, 4A, and 4B.

While traveling through water, the inclination creates a lifting effect to initiate hydroplaning and prevents the leading edge of the surf article from inadvertent diving. Together with the rest of the lower surface, which may be generally planar, the lower surface provides a desirable planking effect.

Optionally, the inclination terminates at a maximum height that is greater than about 0.5 inches above the generally planar section (e.g. 0.5 to about 3 inches or 0.5 to about 3 inches above), which corresponds to heights H1+H3 in FIG. 3.

Optionally, the inclination terminates at a height that is at least about 1.5 inches above the lowest part of a pair of fins (e.g. about 1.5 to about 4 inches above or about 2 to about 3 inches above), which corresponds to height summed by H1+H2+H3 in FIG. 3. Such a termination of the inclination can optionally be the maximum height of the termination and/or the forward most part of the inclination and/or the nose of the board.

Wave-griping Features

A body surf article of the present invention comprises one or more wave-gripping features. Optionally, the wave-gripping features are provided in pairs, having one of said features of the pair on each side (i.e. each half) of the body surf article.

Useful wave-gripping features include fins (e.g. skegs 40, 42, of FIG. 4A, 4B) and lateral edges (e.g. edges 16, 18, and 95 shown in FIG. 4B).

For example, a body surf article can comprises a pair of fins, a pair of first lateral edges, and/or a pair of second lateral edges.

Optionally, the wave-gripping features taught herein run longitudinally the majority of the length of the lower surface of the body surf article, e.g. as shown in FIG. 3. For example, the wave-gripping features can run the entire length of the lower surface or substantially the entire length of the lower surface, e.g. as shown in FIG. 3.

As discussed above, the wave-gripping features can be provided in pairs (e.g. one on each lateral half of the board), e.g., symmetrically spaced from an imaginary longitudinal center plane (e.g. imaginary center plane 200 shown in FIGS. 4A, 4B). Accordingly, for the sake of brevity, the present disclosure often only describes one member of the pair (e.g. one of edge 16 or edge 18). However, it is to be understood that body surf article can have, for each wave-gripping feature taught herein, a second wave-gripping feature positioned another half of the board (e.g. an identical wave-gripping feature symmetrically spaced from the imaginary center plane of the lower surface).

Figure 2:
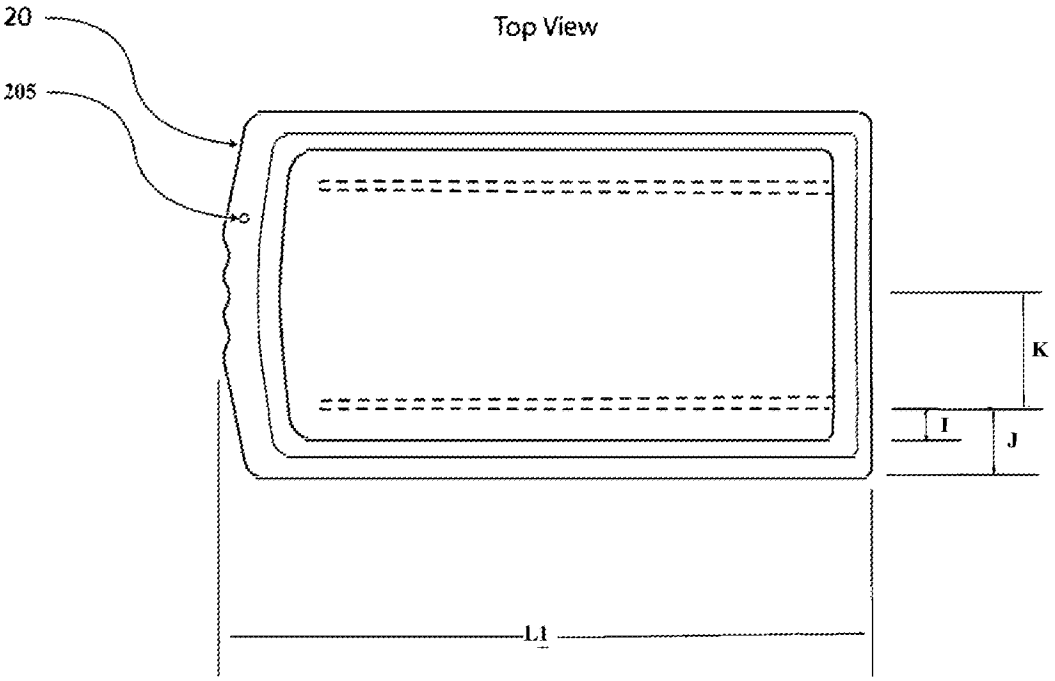
FIG. 2 is a top plan view thereof.

To illustrate a configuration of wave-gripping features, the following example is provided. The body surf article can comprise two halves (e.g. identical halves). Each half of the deck comprises a fin and a lateral end (e.g. skeg 40 and lateral end which provides edge 16). The fin protrudes downward from the lower surface and spans longitudinally towards the trailing edge (i.e. the trailing edge that is on the opposite side of the board than nose 20, FIG. 1). The fin is offset laterally from the lateral end of the respective half (offset defined by dimension J, FIG. 2) such that the lateral end of each of the respective halves provides a respective first edge running longitudinally on the underside of said deck (e.g. edge 16) that is distinct that the bottom edge of the fin. Further, the lateral end is offset laterally from a bottom edge of the fin of the respective half (offset defined by dimension J, FIG. 2) such that the fin is closer to said lateral end of the respective halves than an imaginary longitudinal center plane of the lower surface (e.g. note skeg 40 being substantially closer to edge 16 than center plane 200), i.e. dimension K is larger than dimension J, for example, at least 1.5 times or at least 2 times larger.

Further to the above-mentioned example, the body surf article can comprise on each of said halves, a second lateral edge the second lateral edge runs longitudinally on the lower surface of the deck (e.g. second lateral edge 95, FIG. 4B). The second lateral edge is laterally positioned between the fin (e.g. skeg 40) of the respective half and the first lateral edge (e.g. edge 16) of the respective half, and is positioned at a height that is lower than the first lateral edge and higher than the bottom of the fin. Optionally, the fin is offset laterally from the second lateral edge the respective half (offset defined by dimension I, FIG. 2) such that the fin is closer to said second lateral edge of the respective halves than an imaginary longitudinal center plane of the lower surface, i.e. dimension K is larger than dimension I, for example, at least 2 times or at least 3 times larger. Optionally, the ratio of dimension J to dimension I is no more than 3:1 (e.g. from about 3:2 to about 3:1), e.g. a ratio of about 2:1.

Fins

A body surf article of the present invention can comprise fins, e.g. a left fin extending downward from the lower surface and running longitudinally.

Optionally, the bottom edge of the fin is substantially linear and/or non-stepped.

Optionally, the fin is tapered downward from the lower surface. Optionally, the height of the fin is greater at the rear of the fin than the front of the fin. Optionally, the taper of the fin is configured such that the fin is gradually sloped to become flush with the lower surface at the front of the fin. For example, the fin (otherwise known as a skeg) is tapered or graduated from flush with the lower surface in a linear manner to form a fin protrusion at the rear of the board. For example, the front of the fin can gradually decline from front to back of the fin.

Optionally, the fin is any thin protrusion that has a height that is at least two times greater than its width (e.g. at least three times greater). Optionally, the fin has a solid core (does not have a not hollow)

Optionally, the front of the fin begins at or in close proximity to where a planar rear portion of the lower surface meets a forward inclination of the lower surface (e.g. at inclination start 144, FIG. 3).

The top of the fin (where it joins the lower surface) can optionally be substantially perpendicular to the lower surface. Further, the lower surface can be perpendicular to the fin, the majority (or substantially all) of the lower surface, or at least the portion of the lower surface that resides between the fins (e.g. portion 142, FIG. 4B) and/or resides between the a fin and a next wave-gripping feature (e.g. edge) that lies outside of the fin (e.g. portion 141, FIG. 4B). For example, the lower surface can comprises, on each of said halves, a first surface portion (portion defined by the combination of portion 141 and portion 142, FIG. 4B) that is substantially perpendicular to the fin of the respective half and extends towards the imaginary center plane of the lower surface from the second lateral edge of the respective half. Optionally, said first surface portion connects the second lateral edge of the respective half to the top of the fin of the respective half. Optionally, the fin comprises sidewalls that extend down from the lower surface perpendicularly to the respective nearest portions of the lower surface (e.g. left and right side walls of skeg 40 are perpendicular to lower portions 141, 142, respectively, FIG. 4B)

Optionally, said fins extend less than 3 inches or less than 2 inches or less than 1 inch down from the lower surface (e.g. about ¾ inch at the most, e.g. at the rear of a graduated fin), e.g. at a rear termination of the fin (see height H2, FIG. 3)

Lateral Edges

A body surf article of the present invention at least comprises a first pair of lateral edges on the lower surface, e.g. provided by lateral ends of the deck (e.g. edges 16 and 18, FIG. 4A, 4B). Optionally, the body surf article further comprises a second pair of lateral edges on the lower surface, e.g. that are inset from the first pair of lateral edges and optionally outset from a pair fins, i.e. each second lateral edge is between a fin and a first lateral edge (e.g. edge 95 inset from edge 16 and between edge 16 and skeg 40, FIG. 4A, 4B).

Optionally, the first pair of lateral edges are provided by a flange (e.g. the flange shown in FIG. 1 that extends around the perimeter of the body surf article and forms the nose 20, edges 16, and 18, and trailing edge).

Optionally, the flange extends further outward (laterally) than a planar portion of the lower surface (e.g. a planar portion that comprises the majority of the area of lower surface), e.g. as shown in FIG. 4A, 4B.

Optionally, the flange extends further outward (laterally) than a sidewall of the upper surface, e.g. as shown in FIG. 1.

Optionally, the flange is a horizontally projecting feature, which extends from a vertical or upward rising outer surface (e.g. the upward rising surface on the lower portion of the arc that connects edge 95 and edge 16).

Figure 7A:
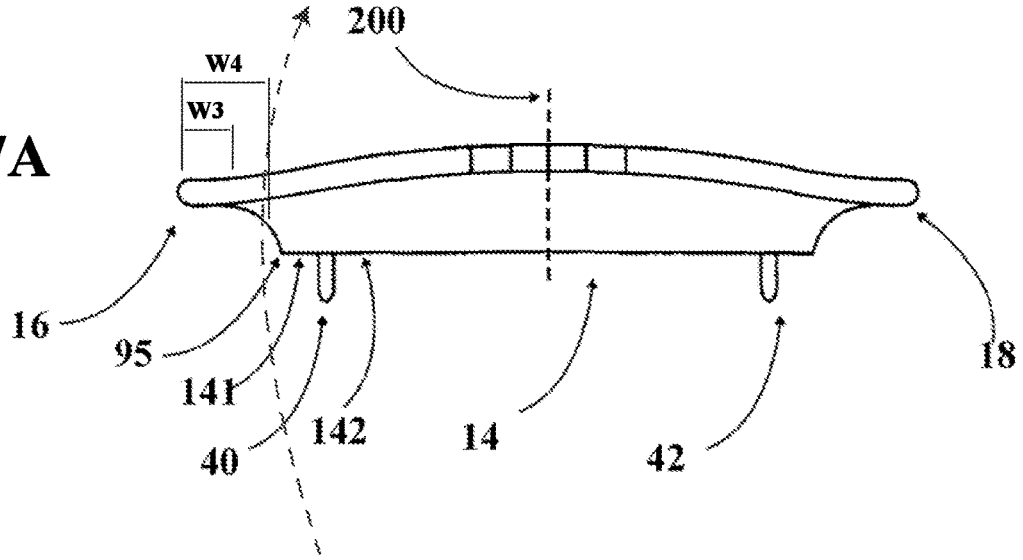
FIGS. 7A, 7B, and 7C depict a body surf article of the invention interacting with waves of different angles. The water surface is shown by the curved dashed line with an arrowhead.

Optionally, the flange is a feature that extends further outward than a vertical or upward rising outer surface, wherein the flange comprises a lower surface that is horizontal or substantially horizontal (substantially horizontal being less a 20 degree angle from true zero degrees). Such a flange provides a shelf on its underside that can dig into wave, and can even can act as the only supporting structure when the wave is substantially vertical, as depicted in FIG. 7A.

Optionally, the flange has thickness (height span) no greater than 1 inch, or no greater than 0.7 inch, or no greater than ½ inch or no greater than $\frac{1}{8}^{th}$ inch.

Optionally, the underside of the flange has a horizontal underside with a lateral extension (W3, FIG. 7A) of at least $\frac{1}{8}^{th}$ inch, e.g. about ⅛ inch to about ¾ inch. Surprisingly, even such a short horizontal extension is sufficient to dig into the wave to act as the only supporting structure, as shown in FIG. 7A.

Optionally, the underside of the flange has an underside that is no greater than 45 degrees (i.e. from horizontal to 45 degrees) with a lateral extension (W4, FIG. 7A) of at least $\frac{1}{8}^{th}$ inch, e.g. about ⅛ inch to about 1 inch or about. about ⅛ inch to about ¾ inch. Surprisingly, even such a short horizontal extension is sufficient to dig into the wave to act as the only supporting structure, as shown in FIG. 7A.

Figure 7B:
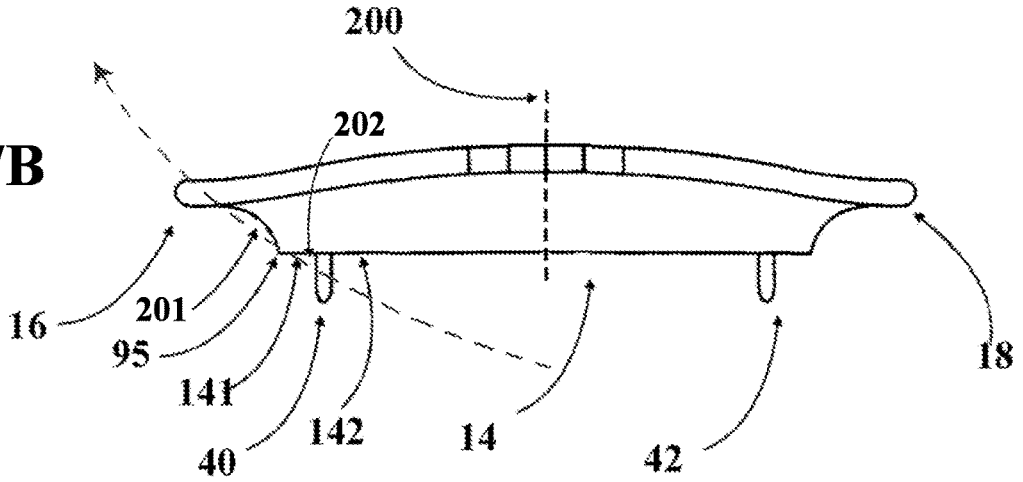
Figure 7C:
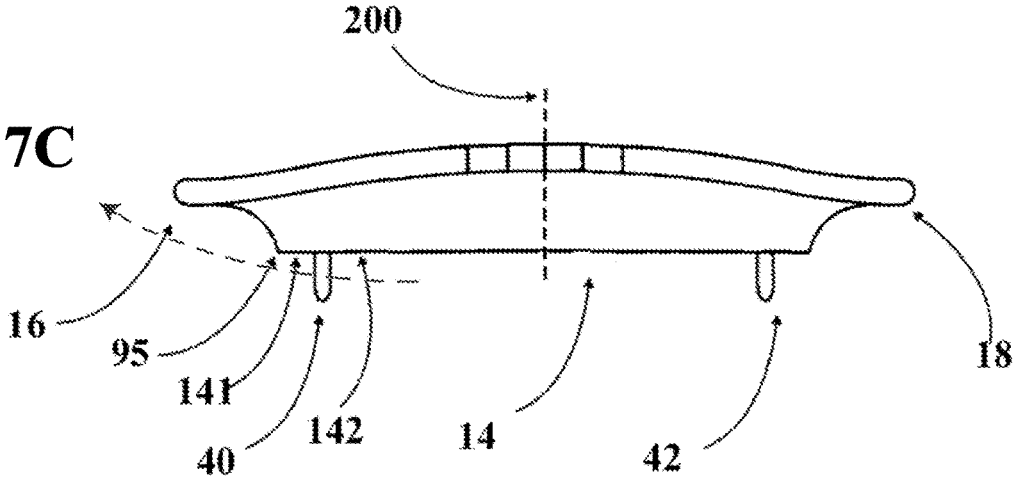

Optionally, the body surf article further comprises a second pair of lateral edges on the lower surface, e.g. that are inset from the first pair of lateral edges and optionally outset from a pair fins, i.e. each second lateral edge is between a fin and a first lateral edge (e.g. edge 95 inset from edge 16 and between edge 16 and skeg 40, FIG. 4A, 4B). Such an a second pair of lateral edges provides an intermediate ridge that can provide wave-gripping function, in combination with one or more of the first lateral edge and a fin when the body surf article is at a certain angle relative to the wave (e.g. see FIG. 7B). While the first lateral edge 16 can provide the sole wave-gripping feature when the wave is vertical or substantially perpendicular relative to the body surf article (FIG. 7A) and the fins 40,42 can provide the sole wave gripping-features when the wave is nearly flat relative to the body surf article (FIG. 7C), the second edge 95 provides a secondary wave-gripping edge when the wave face changes from horizontal to vertical. At this transition angle, the primary wave gripping edge (flange having edge 16 or fin 40) becomes less effective on its own due to the interaction angle of the wave relative to the flange or fin. In other words, the further from a 90 degrees interface between the water surface and the wave gripping feature (90 degree interaction shown in FIGS. 7A and 7C), the less effective a single gripping feature becomes. Accordingly, an optional embodiment provides a second lateral edge 16 that is disposed between the first lateral edge and the fin. While FIG. 7B shows space between the water surface and the inter-edge channels 201 and 202 (channels described below), in practice, edges 16 and 95 act to channel into the void provided by inter-edge channel 201 and edge 95 and fin 40 act to channel into the void provided by inter-edge channel 202 intermediate edge, thus causes the intermediate second edge 95 to penetrate further past the water surface, enhancing gripping contact with the water. Further, the intermediate second edge can be substantially in line with the edge 16 and fin 40, or can be slightly retracted as shown in in the figures, because, due to the penetration of edge 16 and fin 40 through the water surface, the intermediate edge 95 will make gripping contact with the water as shown in FIG. 7B.

Inter-edge Channels

The wave-gripping features, such as fins and/or lateral edges, are configured to extend into a wave. As such, these wave-gripping features protrude substantially from a main body of the deck. To configure the wave-gripping features for adequate protrusion, the surf body article can comprise inter-edge cavities (voids) that form channels between the wave-gripping features, and to allow the passage of water through the void. For example, FIG. 7B shows channel 201 between edge 16 and edge 95 and channel 202 between edge 95 and fin 40.

Optionally, the body surf article comprises on each half, a first longitudinal void channel between a lateral end (which provides a lateral edge) and another wave-gripping feature such as a fin or a second lateral edge. Optionally, the first void channel is concave in shape (e.g. channel 201). Optionally, the first void channel comprises an arc of at least 45 degrees, e.g. at least 60 degrees, or at least 70 degrees (e.g. channel 201). For example, the arc can be about 90 degrees as comprised by the concave channel void 201 shown in FIG. 7B. As an alternative to an perfect arc, another concave shape or curve, or void shape having hard angles rather than a smooth curve. Further, the invention contemplates an alternative example in which skeg 40 is moved to the outer edge 95 of lower surface 14 (effectively removing edge 95 as a wave-gripping feature and replacing it with skeg 40), in which case the concave arc 201 would directly connect edge 16 and skeg 40.

Optionally, the lower surface is configured to provide, on each half of the body surf article, a void channel between the bottom of a fin of the respective half and a second lateral edge (a second lateral edge between the lateral end and the fin). For example, FIG. 4B depicts a void channel between skeg 40 and edge 95, noting that the void channel is defined by the top left corner of the skeg 40 and portion 141 of the lower surface (this void channel is labeled 202 in FIG. 7B and has a shape of a right triangular prism that extends longitudinally down the board, as can be seen by the right triangle shape of the two-dimensional front view of the void channel).

Leading Edge and Leading Flange

A body surf article of the invention comprises a leading end or "nose", (e.g. nose 20, FIG. 1)

Optionally, the nose is formed at end of a tapered or inclined leading end (relative to the lower surface), creating an angular forward hydrofoil behind the nose.

Optionally, the leading end comprises a flange extending forward with respect to a lower surface inclination and/or a sidewall of the upper surface (e.g. the forward sidewall that is at the front of the inset in the upper surface depicted in FIG. 1, and joins the inset to the nose 20).

Optionally, the flange of the nose further forms a finger grip (e.g. having a plurality of indentations), e.g. finger grip 32.

Optionally, the flange portion of the nose is further upwardly oriented than a planar portion of the lower surface (e.g. a planar portion that comprises the majority of the area of lower surface such as the planar portion between edge 95 and the mirror image edge (mirrored edge not numbered) on the other side of plane 200), e.g. in order to keep a user's fingers out of the water once under way and hydroplaning.

Optionally, the leading end terminates at a height of about 1 inch to about 4 inches higher than a base of said lower surface (H1+H3 shown in FIG. 3), and optionally an inclination of the lower surface connects said termination to said base (e.g. inclination 30, FIG. 3). Optionally, the leading end terminates at a height of about 1.5 inches to about 4 inches higher than a base of said lower surface, e.g. about 2 inches to about 3 inches higher.

Optionally, the nose extends higher than the sides of the upper surface (e.g. see FIG. 3, noting that H3 is the additional height that the nose extends higher than height H1, the height from the base to the underside of flange that extends laterally.

Trailing Edge

A body surf article of the invention can comprise a trailing edge at the rear of the body surf article. The rear of the body surf article can optionally have a lower surface trailing edge, wherein the lower trailing edge is provided at a height above the base of the body surf article (e.g. offset from the base by a vertical wall or rising wall as shown), e.g. as shown in FIG. 3 (noting that the lower surface trailing edge is at height H3 above the base). Optionally, the rear of the body surf article has a lower surface trailing edge and an upper surface trailing edge (e.g. the lower surface trailing edge shown in FIG. 3 and the upper surface trailing edge immediately above the lower surface trailing edge).

Size

A body surf article of the invention comprises a size that accommodates the forearm of user, but is optionally sized smaller than that which can contact an entire body of an adult user, or a majority thereof, or an entire torso thereof.

Optionally, the body surf article comprises a length of less than 30 inches from the leading end to a trailing end of the deck (L1 , FIG. 1), and a width of less than 18 inches from a first lateral end to second (opposite) lateral end of the deck (W1, L2). Optionally, the length is less than about 30 inches and greater than about 12 inches (e.g. 12 to 25 inches). Optionally, the width is less than about 16 inches and greater than about 8 inches (e.g. 10 to 16 inches).

Optionally, the body surf article comprises a lower surface having a planar section with a length (L2, FIG. 1) that is at least 80% or at least 90% of the length of L1, and/or a width (W2, FIG. 1) that is at least 80% or at least 90% of the length of L1, and/or a width.

As one specific example (Example A), the body surf article can have the following dimensions an overall width (or upper surface width) of 13 inches (W1, FIG. 1) and/or a lower planar section having a width of 11.5 inches (W2, FIG. 1), and can optionally further have an overall length (or upper surface length) of 18 inches (WL, FIG. 1) and/or a lower planar section having a length of 15.5 inches (L2, FIG. 1). As an alternative example, the invention contemplates a body surf article having dimensions that are not less than 40% less and not greater than 40% more than (+/−40% of) the L1, L2, W1, and W2 of the Example A (or of W1 and L1, or W2 and L2). As yet other alternative examples, the invention contemplates a body surf article having dimensions that are +/−30%, +/−20%, or +/−10% of the L1, L2, W1, and W2 of Example A or of W1 and L1, or W2 and L2).

Optionally, dimension I is about 0.5 inches to about 2 inches, e.g. about 1 inch (where dimension I is measured laterally from either the top of the fin or the bottom of the fin, noting these measurements would be the same with a perfectly vertical fin).

Optionally, dimension J is about 0.5 inch to about 4 inches, e.g. about 2 inches (where dimension J is measured laterally from either the top of the fin or the bottom of the fin, noting these measurements would be the same with a perfectly vertical fin).

Density

As taught herein, a body surf article can be configured with a desired buoyancy, e.g. configured with substantially less buoyancy than traditional surf articles such as surfboards and body boards. Such a density provides ease of submerging the article down into the water (when submerging is desired and not in planing use), and provides an article that is less effected by water undulation (when not in planing use).

Optionally, the entire body surf article, or deck thereof and fins thereof, has a density close to that of water, e.g. at least about about 0.65 grams/cm$^3$ and, for example, no more than about 1.2 grams/cm$^3$. Optionally said density is about 0.8 grams/cm$^3$ to about 1.2 grams/cm$^3$. Optionally, said density is at least 0.85 grams/cm$^3$. Optionally, said density no greater than about 1.05 grams/cm$^3$. As a specific example, the density can be about 0.9 grams/cm$^3$ to about 1 gram/cm$^3$.

The "density" referred to herein is the functional density, i.e. based on the effective volume. In other words, the volume used for density calculation (where density equals mass/volume) is calculated by submerging the body surf article in water. For example, an enclosed hollow shell would have a density based on the volume of the entire three-dimensional shape, not merely the small volume of the shell walls.

One optional construction includes the body surf article being molded or formed as a unitary body of a material having an overall density that is less than that of water, but not more than about 10% or 20% greater than water (e.g. less than 1.1 or 1.2 g/cm$^3$.

The density taught herein provides unexpected advantages for the user. "Duck diving" is a maneuver which is used by surfers, while they are paddling out from shore, when an oncoming wave is about to hit them. To duck dive, the user will point the nose of the board down or into the wave crest and pierce through the wave, coming out the other side of the wave, rather than having the wave begin to carry the user into shore which is what happens in the absence of duck diving. Duck diving is very difficult to perform with traditional boogie boards because they are large and made from low density materials (typically closed cell foam) which are very buoyant. In contrast, with the density and construction of body surf articles of the present invention allow for functional control while riding through a cresting water wave and allowing ease of "duck diving" down into a wave without substantial buoyancy effect that makes duck diving extremely difficult, while optionally the body surf article still has a density that is less than that of water thereby preventing the article from sinking too deep to avoid loss of the board. The design and configuration of the body surf article of the invention reduces the physical effort to submerge the article. Surprisingly, through insight of the inventor, a body surf article of the invention makes it nearly effortless for a user to submerge the board under waves and large walls of foam or white aerated water.

As described above, the body surf article can have a density that provides desirable buoyancy properties (i.e. the absence of extreme buoyancy). In the prior art, extremely buoyant water craft (e.g. boogie boards, surf boards, boats) were typically provided using materials that are cellular and/or foam-based or made from non-cellular or non-foam materials but having a hollow core to provide the buoyancy. In contrast, one embodiment of the present invention provides a body surf article that is optionally non-cellular, non-foam-based, and/or non-hollow.

Molding and Unitary Formation

In one embodiment, the body surf article is molded or formed as a unitary body, e.g. having an overall density that is essentially similar to that of water. For example, the body surf article can be made from a mold (e.g. injection mold).

Useful materials include plastic, fiberglass, graphite, carbon fiber, wood, and other materials that may be configured to have a density as taught herein. Other materials that meet the density requirements of the present invention include materials uses in the field of water ski manufacturing.

According to one aspect of the present invention, the body surf article is formed of a shatterproof plastic material. Such materials may include many types of plastics (e.g. neoprene, ABS, PE/HOPE, or others), or fiber reinforces resins, or wood materials, or combinations thereof Other Features Optionally, the body surf article comprises a hole, e.g. near or in a flange (e.g. leading edge flange) or near an outer edge of the body surf article, e.g. hole 205 of FIG. 2. The hole may comprise a grommet. Such a hole or grommet can be used to tie a surf leash. Alternatively, the body surf article can comprises a leash plug, e.g. as used on surfboards.

EXAMPLES

Example 1 Body Surf Article

Briefly described according to the present invention, a body surfing apparatus is provided forming a generally planar deck surface circumscribed by a flange. A nose 20 is formed in front of tapered leading edge 30 creating an angular forward hydrofoil. The flange portion of the nose further forms a finger grip 32 at the upper edge. A planar lower surface 14 has integrated a pair of ribs or fins forming a right graduated skeg 40 parallel to a left graduated skeg 42. Each skeg is graduated from flush with the lower surface in a linear manner to form a fin protrusion at the rear of the board, as shown in FIG. 3. The overall construction of the body surfing board is molded or formed as a unitary body of a material having an overall density that is essentially similar to that of water. Within such a density range the board will be prevented from sinking too deep resulting in loss of the board, and still allows ease of duck diving under waves, without too much of a buoyancy effect.

As best shown in conjunction with FIG. 1 through FIG. 4, the body surfing board has a deck forming a generally planar upper surface 12 and a planar lower surface 14. The deck surface is circumscribed by a flange forming a right wave face grip edge 16 opposite a left wave face grip edge 18. A nose 20 is formed at the front of a tapered inclination creating an angular forward hydrofoil 30. The flange portion of the nose 20 forms a finger grip 32, and is further upwardly oriented in order to keep a user's fingers out of the water once under way and hydroplaning. Such a position prevents drag during operation. Further, the planar lower tray 14 has integrated a pair of ribs or fins forming a right graduated skeg 40 parallel to a left graduated skeg 42. Each skeg 40, 42 is graduated from flush with the lower surface 14 in a linear manner to form a fin protrusion at the rear of the board The deck has an overall width W1, and an overall length L1, with the height H1 of the tray 14. An additional second height H2 is that of the skegs 40/42, and a third overall height H3 is of the nose 20. While specific dimensions may be varied within the overall scope of the present invention, according to one aspect of the present invention the width W1 and length L1 are capable of providing a contact surface for supporting a user's forearm. According to another aspect of the present invention the width W1 is approximately 13 inches. According to another aspect of the present invention, the length L1 is approximately 18 inches. According to yet another aspect of the present invention the tray height H1 is approximately ¾ inch According to yet another aspect of the present invention the second height H2 of the skegs 40/42 terminates at approximately ¾ inch. According to yet another aspect of the present invention the third overall height H3 of the nose 20 is less than approximately 2 inches.

The overall construction of the body surfing article may include a variety of designs and configurations within the overall range of equivalents of the features and functions described herein. One such construction may include the board 10 being molded or formed as a unitary body of a material having an overall density that is less than that of water, but not more than about 10% or 20% greater than water (e.g. less than 1.1 or 1.2 g/cm$^3$. Within such a density range the board 10 will be prevented from sinking, while at the same time allow for functional control while riding through a cresting water wave. As should be known by those having ordinary skill in the relevant art, currently available body surfing boards such as boogie boards utilize substantially closed cell foam structures, alone or in combination with other materials, to form a platform that has significant buoyancy. However, such structures create buoyancy even while traveling through the aerated foam white water and in doing so prevent controlled operation there through.

According to a preferred aspect of the present invention the board 10 is formed of a shatterproof plastic material. Such materials may include many types of plastics (e.g. neoprene, ABS, PE/HOPE, or others), or fiber reinforces resins, or wood materials, or combinations thereof.

Example 2 Method of Use

Figure 5:
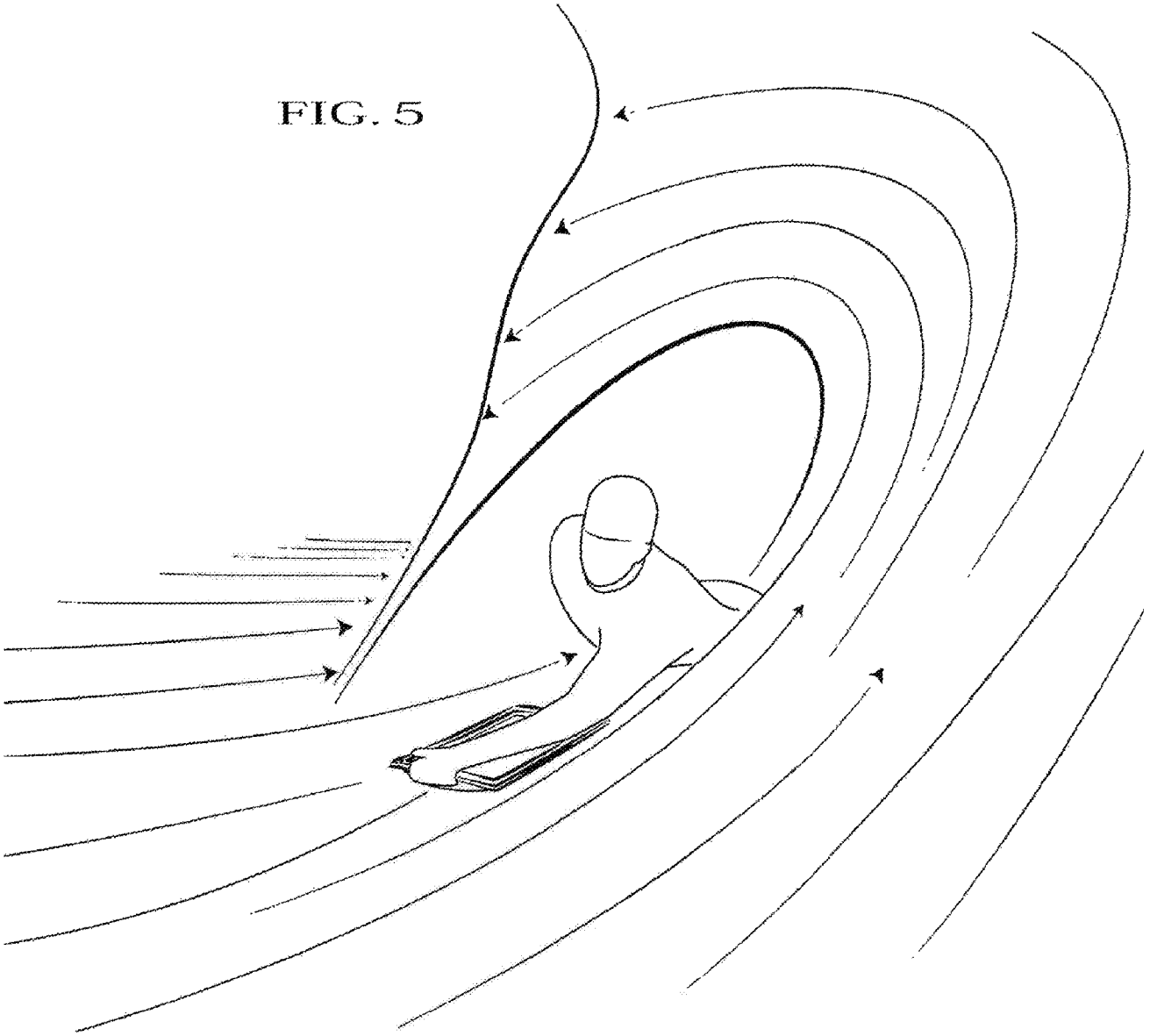
FIG. 5 is a perspective view of an improved body surfing board according to the preferred embodiment of the present invention shown demonstrated in use during surfing on a water wave.
Figure 6:
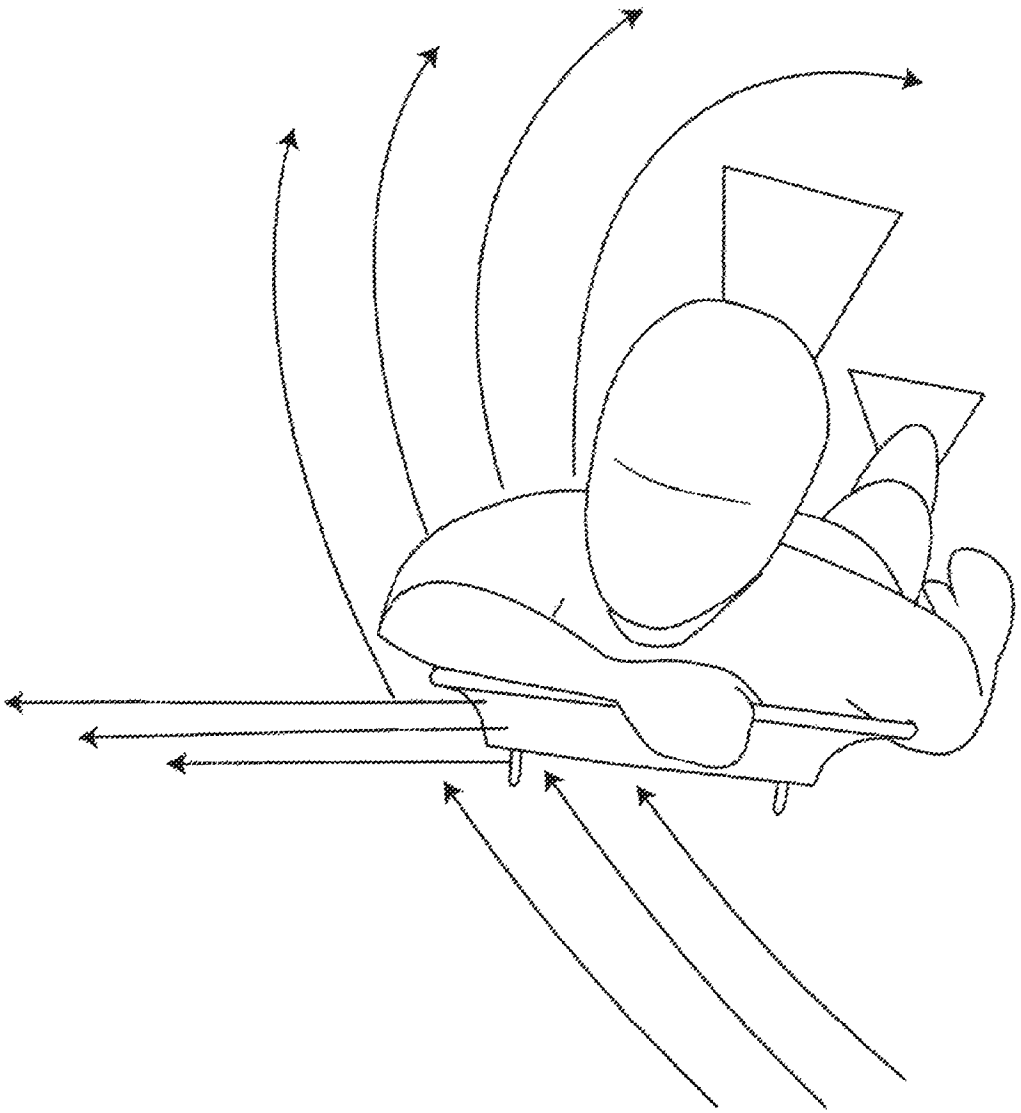
FIG. 6 is a front elevational view of the demonstration of FIG. 5.

The operation and principles of operation of the present invention are best shown in combination with FIG. 5 through FIG. 6. As outlined therein, in an intended use a user grasps the body surfing board of the present invention with one hand along the front grip 32. With the deck upper surface 12 placed against a user's forearm, a user may then surf across the smooth face of a water wave. In this manner the inner or leading skeg provides directional guidance in conjunction with the actions of the use, and prevents the user from sliding down the steep face of the wave. The inner skeg (fin) 40, as well as the sharp wave face grip edge 16, and the sharp corner 95 of the lower surface 14 grip the smooth face of the wave and prevent the user from sliding down the smooth face of the wave and thrust the user forward instead, hydroplaning across the smooth face of the wave once up to speed.

Further, due to the density of the materials used, as shown in conjunction with FIG. 7 the submerged skeg remains in the smooth water on the face of the wave while traveling across the the wave.

Further, as shown in FIG. 6, the use of multiple wave-gripping features that are spaced laterally and horizontally from each other provide a configuration in which, at any given time, one or more of the wave-gripping features are gripping the wave, depending on the angle of the board which respect to the wave. For example, as shown in FIG. 6, in which the board is at an approximate angle of 45 degrees relative to the wave face, all three wave-gripping features 16, 95, and 40 make contact with the wave. It can be seen that the fin extends down perpendicularly to the plane of the lower surface 14 and the each of the fin 40, edge 95, and edge 16 are in line with each other, and have sufficient inter-wave-gripping channel voids that allow maximum grip on the wave and the channeling of water though each void. This configuration is in contrast to boat hull strakes which are typically have very little outward projection (relative to the size of the water craft) and would not substantially reduce lateral slippage due to gravity.

The foregoing descriptions of specific embodiments of the present invention are presented for purposes of illustration and description. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of Warner-Jenkinson Company, v. Hilton Davis Chemical, 520 US 17 (1997) or Festo Corp. v. Shoketsu Kinzoku Kogyo Kabushiki Co., 535 U.S. 722 (2002), or other similar case-law or subsequent precedent should not be made if any future claims are added or amended subsequent to this patent application.

The citations provided herein are hereby incorporated by reference for the cited subject matter.

What is claimed is:

1. A body surf article comprising:

a deck having:

an upper surface on a top side of the deck;

a lower surface on an under side of the deck that inclines to a leading end;

a length of less than 30 inches from the leading end to a trailing end of the deck; and a width of less than 16 inches from a first lateral end to a second lateral end of the deck;

wherein the deck has density no less than 0.65 g/ cm$^3$;

the lower surface comprises a portion behind the inclination that is substantially planar, optionally wherein substantially all or a majority of the lower surface behind the inclination is substantially planar;

the upper surface comprises a portion that is substantially planar, optionally, wherein substantially all or a majority of the upper surface is substantially planar;

the body surf article further comprises, on each half of said deck, a) a fin protruding downward from the lower surface and spanning longitudinally, and b) a lateral end;

the fin is offset laterally from the lateral end of the respective half such that the lateral end of each of the respective halves provides a respective first edge running longitudinally on the underside of said deck;

the fin is closer to said lateral end of the respective half than an imaginary longitudinal center plane of said deck;

optionally, wherein the fin is tapered downward from the lower surface, optionally, wherein the height of the fin is greater at the rear of the fin than the front of the fin; and optionally, the taper of the fin is configured such that the fin is gradually sloped to become flush with the lower surface;

the body surf article further comprises, on each of said halves, a second lateral edge;

the second lateral edge is laterally positioned between the fin of the respective half and the first lateral edge of the respective half;

the second lateral edge is positioned at a height that is lower than the first lateral edges and higher than the bottom of the fins; and the second lateral edge runs longitudinally on the underside of said deck.

2. The surf body article of claim 1, further comprising, on each of said halves, a concave surface connecting the second lateral edge of the respective half and the first edge of the respective half.

3. The surf body article of claim 2, wherein the lower surface comprises, on each of said halves, a first surface portion that is substantially perpendicular to the fin of the respective half and extends towards the imaginary center plane of the lower surface from the second lateral edge of the respective half, optionally wherein said first surface portion connects the second lateral edge of the respective half to the top of the fin of the respective half.

4. The surf body article of claim 1, wherein, the lower surface is configured to provide, on each of said halves, a first longitudinal void channel between the bottom of the fin of the respective half and the second lateral edge of the respective half to allow the passage of water as the surf body article travels through water.

5. The surf body article of claim 1, wherein the lower surface is configured to provide, on each of said halves, a second longitudinal void channel between the first lateral edge of the respective half and the second lateral edge of the respective half to allow the passage of water as the surf body article travels through water.

6. A body surf article comprising:

a deck having:

an upper surface on a top side of the deck;

a lower surface on an under side of the deck that inclines to a leading end;

a length of less than 30 inches from the leading end to a trailing end of the deck; and a width of less than 16 inches from a first lateral end to a second lateral end of the deck;

wherein the deck has density no less than 0.65 g/cm$^3$;

the lower surface comprises a portion behind the inclination that is substantially planar, optionally wherein substantially all or a majority of the lower surface behind the inclination is substantially planar;

the upper surface comprises a portion that is substantially planar, optionally, wherein substantially all or a majority of the upper surface is substantially planar;

the body surf article further comprises, on each half of said deck, a) a fin protruding downward from the lower surface and spanning longitudinally, and b) a lateral end;

the fin is offset laterally from the lateral end of the respective half such that the lateral end of each of the respective halves provides a respective first edge running longitudinally on the underside of said deck;

the fin is closer to said lateral end of the respective half than an imaginary longitudinal center plane of said deck;

optionally, wherein the fin is tapered downward from the lower surface;

optionally, wherein the height of the fin is greater at the rear of the fin than the front of the fin;

optionally, the taper of the fin is configured such that the fin is gradually sloped to become flush with the lower surface; and the lower surface is configured to provide, on each of said halves, a longitudinal void channel between the first lateral edge of the respective half and the fin of the respective half to allow the passage of water as the surf body article travels through water.

7. The body surfing article of claim 6 wherein the leading end comprises a flange having a finger grip.

8. The body surfing article of claim 6, wherein the deck and fins are molded or formed as a unitary body.

9. The body surfing article of claim 6, wherein said fins terminate at a height of less than approximately 1 inch below the lower surface.

10. The body surfing article of claim 6, wherein said leading end terminates at a height of about one inch to about three inches higher than a base of said lower surface, and optionally said inclination connects said termination to said base.

11. The body surf article of claim 6, wherein the deck has a density of at least 0.85 g/cm$^3$.

12. The body surf article of claim 6, wherein the deck has a density of about 0.8 g/cm$^3$ to about 1.2 g/cm$^3$.

13. The body surf article of claim 1, wherein the deck has a density of at least 0.85 g/cm$^3$.

14. The body surf article of claim 1, wherein the deck has a density of about 0.8 g/cm$^3$ to about 1.2 g/cm$^3$.

* * * * *